US005319808A

United States Patent [19]

Bishop et al.

[11] Patent Number: 5,319,808

[45] Date of Patent: Jun. 14, 1994

[54] IMPACT ABSORBING PROTECTIVE CAP

[75] Inventors: Timothy D. Bishop, Claymont, Del.; G. Kenneth Harding, Chadds Ford, Pa.

[73] Assignee: Fibre-Metal Products Co., Concordville, Pa.

[21] Appl. No.: 890,830

[22] Filed: Jun. 1, 1992

[51] Int. Cl.[5] ..... A42B 3/00

[52] U.S. Cl. ..... 2/416; 2/411; 2/181.8; 2/181.2

[58] Field of Search ..... 2/410, 411, 416, 417, 2/418, 419, 420, 412, 181.6, 181.8, 181, 181.2

[56] References Cited

U.S. PATENT DOCUMENTS

| | | | |
|---|---|---|---|
| 109,473 | 11/1870 | Warborton | 2/181.6 |
| 662,645 | 11/1900 | Halbert | 2/181.8 |
| 960,251 | 6/1910 | Beenken | 2/181.6 |
| 1,153,907 | 9/1915 | Halbert | 2/181.8 |
| 1,170,052 | 2/1916 | Diener et al. . | |
| 1,345,933 | 7/1920 | Knight . | |
| 1,652,776 | 12/1927 | Galanis . | |
| 2,218,590 | 10/1940 | Szumkowski . | |
| 2,557,123 | 6/1951 | Lyon | 2/181.8 |
| 3,156,922 | 11/1964 | Anderson | 2/419 |
| 3,447,163 | 6/1969 | Bothwell et al. . | |
| 3,877,076 | 4/1975 | Summers et al. . | |
| 4,055,860 | 11/1977 | King | 2/416 |
| 4,307,471 | 12/1981 | Lovell . | |
| 4,343,047 | 8/1982 | Lazowski et al. . | |
| 4,412,358 | 11/1983 | Lavender . | |
| 4,432,099 | 2/1984 | Grick et al. . | |
| 4,463,456 | 8/1984 | Hanson | 2/416 |
| 4,472,472 | 9/1984 | Schultz . | |
| 4,538,301 | 9/1985 | Sawatzki et al. . | |
| 4,586,200 | 5/1986 | Poon . | |
| 4,724,549 | 2/1988 | Herder et al. . | |
| 4,972,527 | 11/1990 | Wallace . | |
| 4,987,609 | 1/1991 | Zahn . | |

FOREIGN PATENT DOCUMENTS

| | | | |
|---|---|---|---|
| 931703 | 8/1973 | Canada | 2/416 |
| 1128156 | 4/1962 | Fed. Rep. of Germany | 2/419 |
| 998695 | 7/1965 | United Kingdom | 2/420 |

*Primary Examiner*—Clifford D. Crowder
*Assistant Examiner*—Michael A. Neas
*Attorney, Agent, or Firm*—Connolly & Hutz

[57] ABSTRACT

An impact absorbing protective cap includes a rigid shell which fits on the head of the wearer. The shell is generally hemispherical in shape and terminates in a peripheral edge which defines an open space. An attenuator band is mounted to the inner surface of the shell generally at the peripheral edge for distributing lateral impact forces striking the outer surface of the shell. The attenuator band is made of flexible hard material and is in corrugated form with a series of undulations alternately disposed toward and away from the inner surface of the shell.

39 Claims, 5 Drawing Sheets

IMPACT ABSORBING PROTECTIVE CAP

BACKGROUND OF THE INVENTION

There are many occupations and activities which require the use of protective caps. In particular, such protective caps are a necessity in industrial environments. Protective caps are also used in other activities which might involve the application of force to the head, such as a batting helmet for baseball.

Much effort has been expended in designing protective caps capable of providing protection against vertical blows to the head. A particularly effective protective cap is manufactured by Fibre-Metal Products Co. which includes a rigid shell having an internal headgear and headband. The shell is provided with a suspension system which is designed to help protect the wearer against the impact from a vertical force. This is accomplished by having the shell flex upon an impact to the top of the shell so as to absorb part of the impact force. The smooth ribless surface may further reduce the force transmitted by a glancing blow. The reduced force passes to eight energy distributing points. In this protective cap there are no ribs or surfaces which create weak areas caused by interrupted material flow. The internal suspension also functions to absorb still more of the impact forces. The energy absorbing connections distribute the forces over a greater area of the head, thus reducing concentrations at any one point. Remaining impact forces, are passed to the body's natural shock absorbers.

While the above noted protective cap has proven to be very successful in providing protection against vertical impact forces, it would be desirable to provide a protective cap with some means to also help protect against laterally applied impact forces.

SUMMARY OF THE INVENTION

An object of this invention is to provide a protective cap capable of providing impact absorption to laterally applied forces.

A further object of this invention is to provide such a protective cap which may also incorporate means for providing protection against vertically applied forces so that the resultant protective cap thereby protects the wearer from various types of impact force.

In accordance with this invention an impact absorbing protective cap in the form of a rigid shell of generally hemispherical shape which terminates in a peripheral edge to define an open space therebetween so that the shell can be fit over the head of the wearer. An attenuator band is mounted to the shell at generally the peripheral edge. The attenuator band is made of a flexible, hard material and is of corrugated form with a series of undulations alternately disposed toward and away from the inner surface of the shell to distribute lateral impact forces striking against the outer surface of the shell.

The attenuator band may advantageously be made of a plurality and preferably two individual pieces which are interconnected to form a continuous band. By making the band of a plurality of individual pieces, it is possible to package the band in a flat condition for storage and transport. Alternatively, the band may be formed of an integral one-piece construction.

In the preferred practice of the invention the shell also includes a plurality of spaced energy distributing points to effectively assist in distributing vertically applied impact forces. Preferably each energy distributing point is in the form of an outward bulge with a pair of flanges located on the inner surface of the shell disposed toward each other, but spaced slightly apart to form a slotted pocket. The attenuator band includes a plurality of buttons corresponding to the number of pockets so that the band may be mounted to the shell by sliding each button into a respective pocket.

The attenuator band may also include a plurality of upward extending tabs each of which has a slot. The cap includes a suspension webbing which is secured to the shell by being connected at each slot. Additionally, the cap includes an inner liner mounted at the inner surface of the attenuator band and secured to the attenuator band at each of the slots. This liner provides a means for attachment and will provide means for individual adjustment to the wearer.

THE DRAWINGS

DETAILED DESCRIPTION

Figure 1:
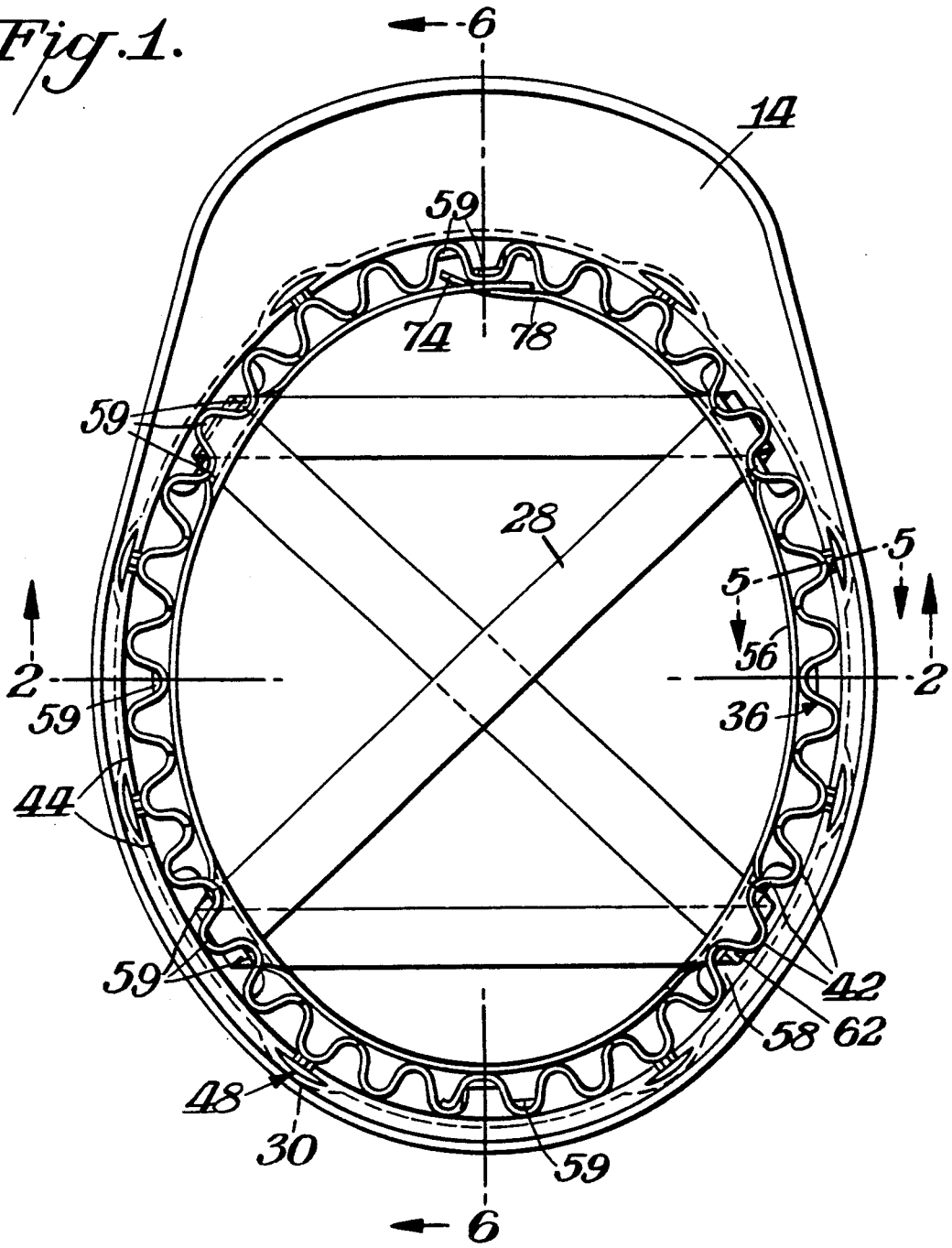
FIG. 1 is a bottom plan view of a protective cap in accordance with this invention.
Figure 2:
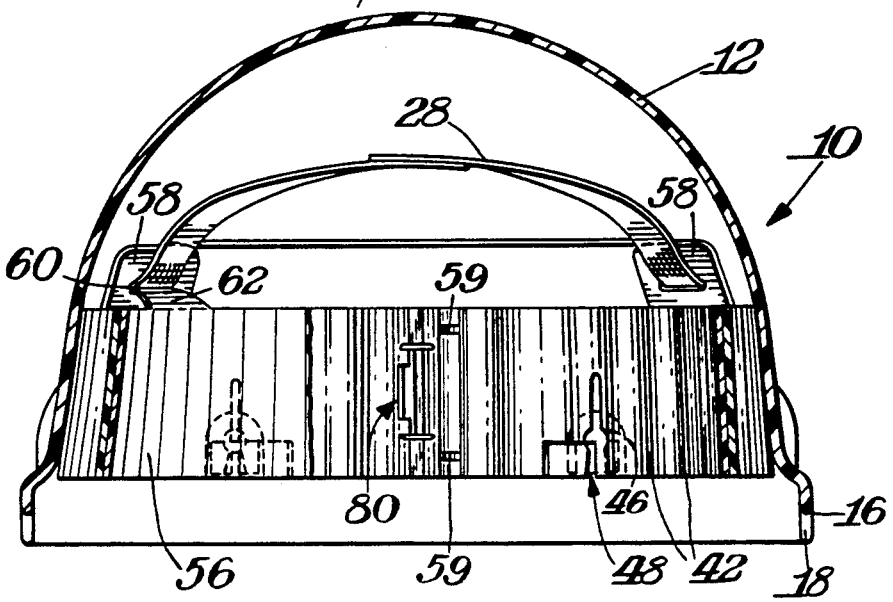
FIG. 2 is a cross-sectional view in elevation taken through FIG. 1 along the line 2—2.

FIGS. 1-2 illustrate a protective cap 10 made in accordance with this invention. As shown therein protective cap 10 is in the form of a rigid shell 12 which is generally hemispherical in shape and which can take any suitable conventional form as is known for safety helmets, such as used for industrial applications. Thus, shell 12 would include a front peak 14 and would include a downward peripheral flange 16 at its lower edge 18 so that the interior of shell 12 is exposed so as to permit cap 10 to be worn by a user.

Figure 6:
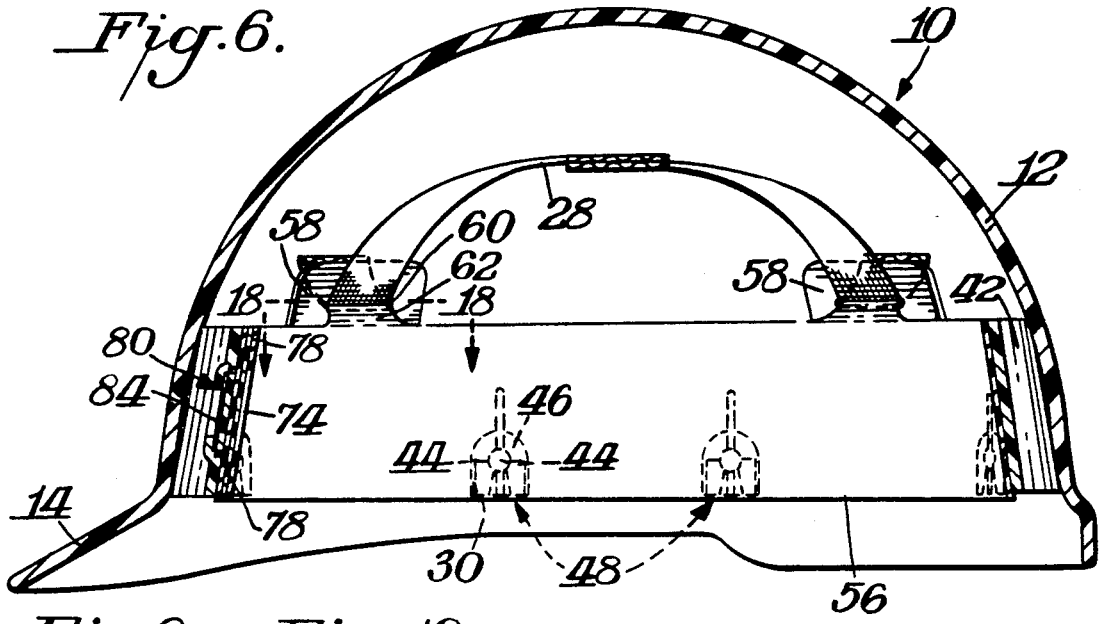
FIG. 6 is a cross-sectional view in elevation taken through FIG. 1 along the line 6—6.
Figure 8:
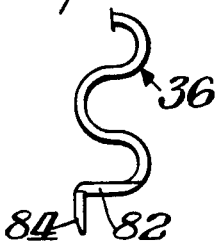
FIG. 8 is a top plan view of the attenuator band shown in FIG. 7.
Figure 10:
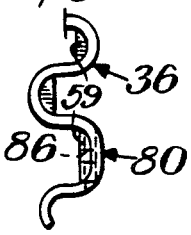
FIG. 10 is a top plan view of the attenuator band shown in FIG. 9.

In the preferred practice of this invention cap 10 incorporates the features of a commercial protective cap manufactured by Fibre-Metal Products Co. of Concordville, Pa. As illustrated, the structure includes an internal headband system. The headband system includes an adjustable headband 20 (FIG. 17) the ends of which have gear rack formations and are inserted into a sleeve member 24. An adjusting knob 26 engages the rack formations for drawing the ends closer together or spreading the overlapped ends further apart as is necessary to conform to the size of the user's head. A suspension webbing arrangement 28 (FIGS. 1, 2 and 6) is provided at the top of the shell 12 spaced from its inner surface.

Any suitable conventional materials may be used for shell 12 and the head band assembly. For example, shell 12 may be made from a heavy duty fiberglass material while the adjustable headband 20 may be made from a stiff plastic material which is capable of bending. Webbing 28 may be made from a suitable fabric material.

As illustrated in various figures a plurality, preferably eight, energy distributing points 30 are disposed around the periphery of shell 12 generally adjacent to the lower peripheral edge 18. Energy distributing points 30 are in the form of outward bulges which function to distribute vertical impact forces as in the commercial cap. Specifically, when a vertical impact is encountered at the top of shell 12, shell 12 flexes absorbing part of the impact force. The reduced force then passes to the eight energy distributing points which transmit the force to the suspension. The webbing or suspension 28 also stretches absorbing still more of the impact forces. The energy distributing connections or points 30 distribute the forces evenly over a greater area of the head reducing the concentrations at any one point.

If desired cap 10 may also include known mounting blocks 32 (FIG. 17) on each side of cap 10, which could be used for mounting auxiliary equipment such as welding shields.

In accordance with this invention advantage is taken of the existence of features in cap 10 which provides protection against vertical impact forces to also provide protection against lateral impact forces. This is achieved primarily by the utilization of the attenuator band 36. As shown in FIG. 1, attenuator band 36 is of corrugated form having a series of undulations which alternate toward and away from the inner surface of shell 12. Band 36 is made of any suitable high impact flexible material, such as high impact PVC or ABS. Band 36 is mounted to the inner surface of shell 12 so as to distribute any lateral impact forces which strike the outer surface of shell 12.

Figure 20:
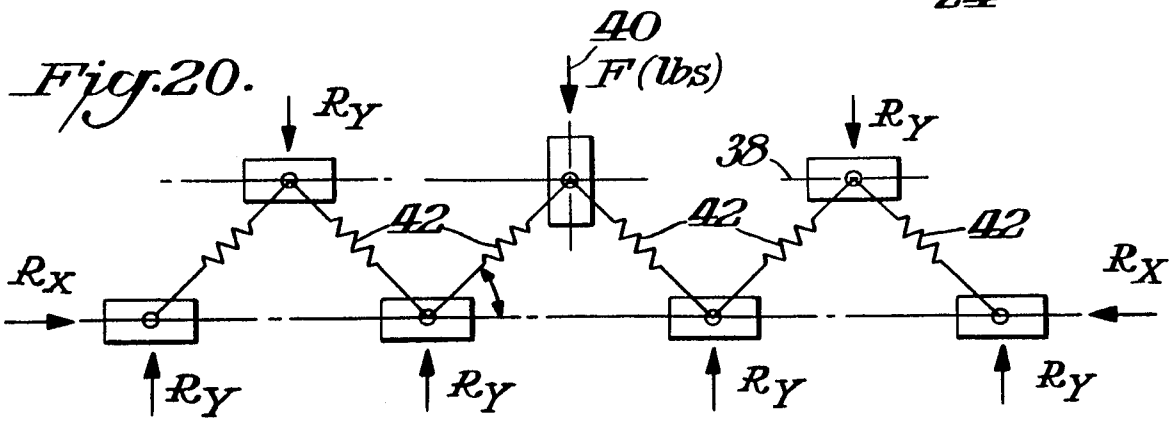
FIG. 20 is a schematic view illustrating the principles of lateral force distribution from the attenuator band of this invention.

The principle of operation of band 36 is illustrated in FIG. 20. As shown therein the undulations act as springs 42 which are angled away from the surface of shell 12. As illustrated in FIG. 20 the shell 12 is represented by reference numeral 38. If a force 40 of magnitude F impacts against shell 12 force F is distributed and the resulting forces Ry and Rx are propagated through attenuator band 36 in the manner illustrated so as to distribute the impact along the corrugations or undulations 42 which act in the manner of springs. Thus, the forces are greatly reduced due to distributed impact and to an energy absorbing deformation of the plastic material of attenuator band 36 which functions as simulated springs.

Figure 3:
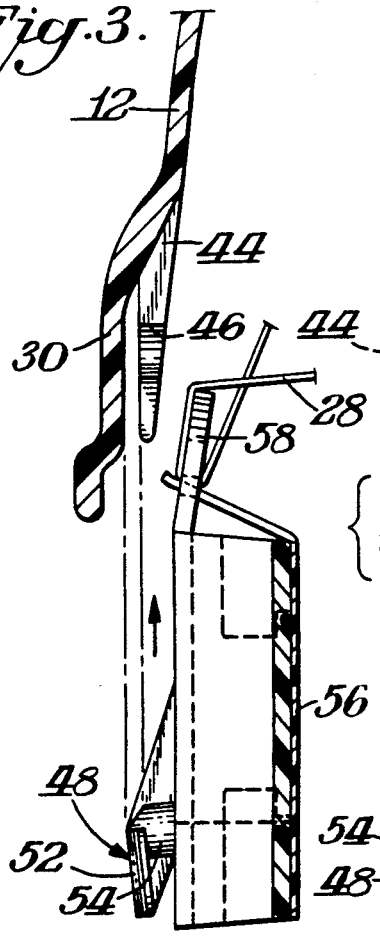
FIG. 3 is an exploded elevational view in section showing a step in the mounting of the attenuator band to the shell of FIGS. 1-2.
Figure 4:
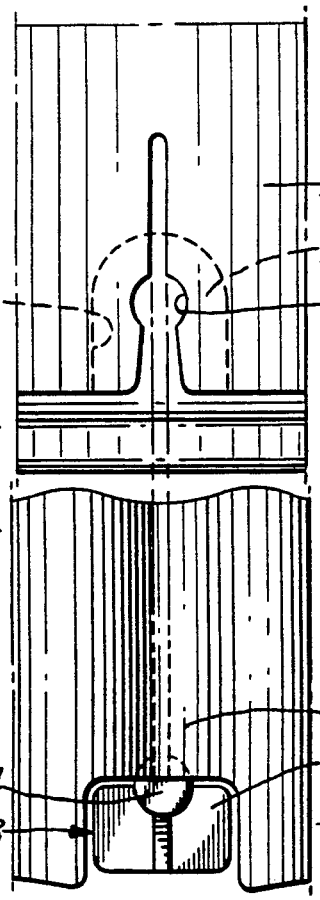
FIG. 4 is a fragmentary side elevational view of the portion of the cap shown in FIG. 3.

Advantageously, the present invention takes advantage of the presence of the energy distributing points 30 to provide a convenient manner of mounting attenuator band 36 to shell 12. As illustrated in FIGS. 3-6 and 13-14, the inner surface of shell 12 at each energy distributing point 30 includes a pair of flanges 44 disposed toward but slightly spaced from each other so as to create a pocket having a slot 46 between the flanges. A coupling mechanism is provided on attenuator band 36 for engagement with any number of and preferably all of the energy distributing points 30. In the preferred embodiment each coupling mechanism includes button 48 extending outwardly from a notched undulation 50. These mounting undulations 50 have notches or cut-outs so as to permit sufficient clearance to accommodate buttons 48 as shown in FIGS. 4. Each button 48 includes an outward flange 52 mounted to a stem 54 which in turn is connected at the notch or cut-out of notched undulations 50. Button 48 is preferably integral with attenuator band 36.

Figure 17:
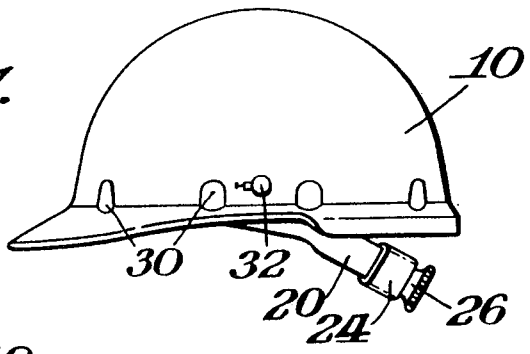
FIG. 17 is a side elevational view of the protective cap of this invention.

For the sake of clarity of illustration, the known adjustable band 20 is shown only in FIG. 17. Adjustable band 20 is mounted to a plastic liner 56 disposed within attenuator band 36. In order to mount liner 56 within cap 10, liner 56 is connected to attenuator band 36. Any suitable means of connection may be used.

Figure 13:
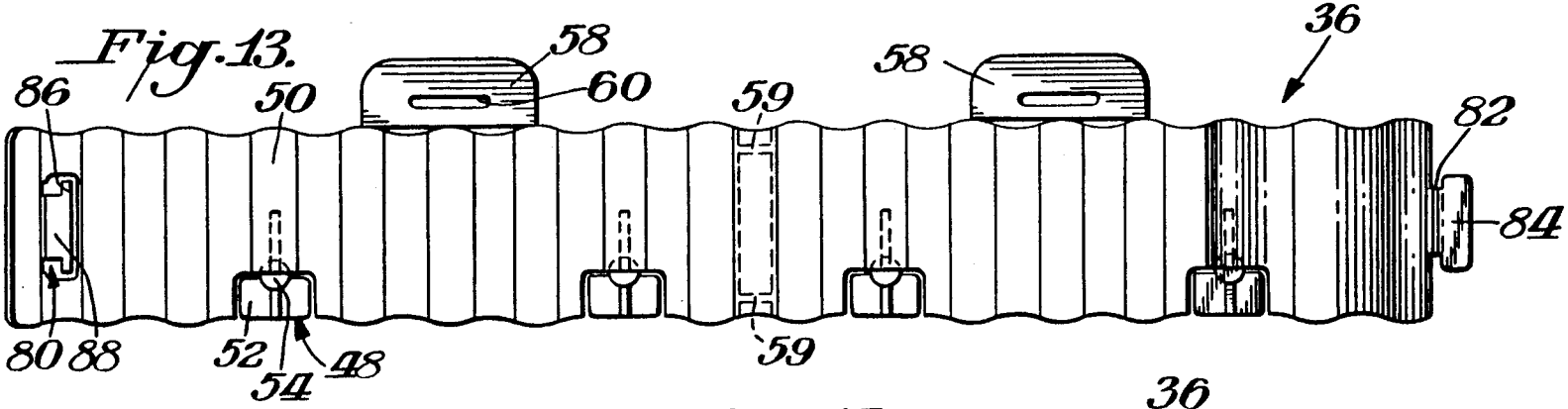
FIG. 13 is a front elevational view showing one of the pieces of an attenuator band in its flat condition in accordance with this invention.
Figure 14:
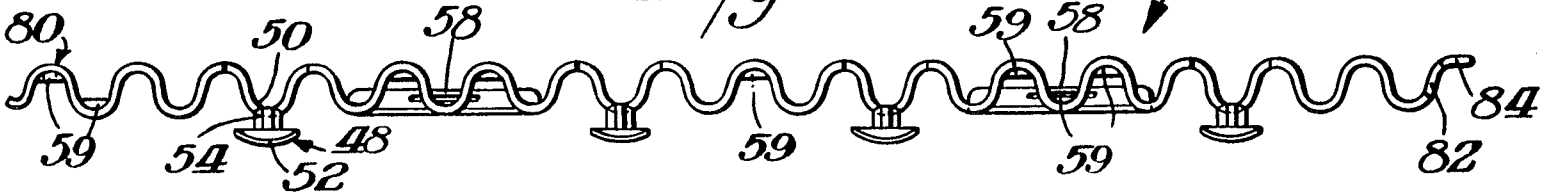
FIG. 14 is a bottom plan view of the attenuator band shown in FIG. 13.
Figure 15:
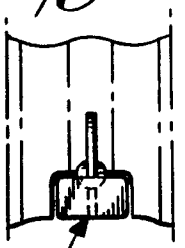
FIG. 15 is a fragmental rear elevational view of an attenuator band in accordance with this invention.
Figure 16:
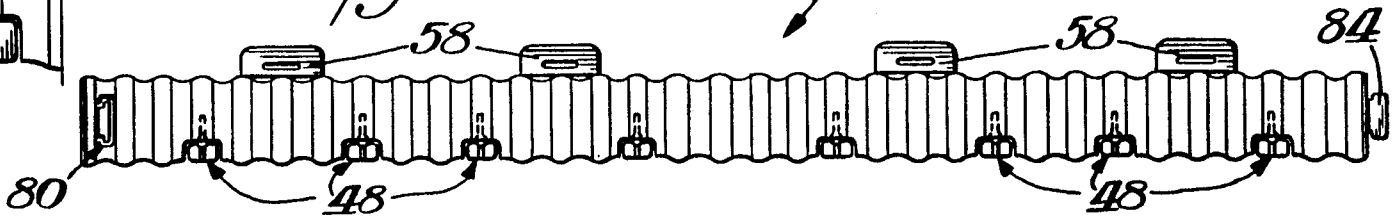
FIG. 16 is a front elevational view of an alternative one piece form of attenuator band in accordance with this invention.
Figure 19:
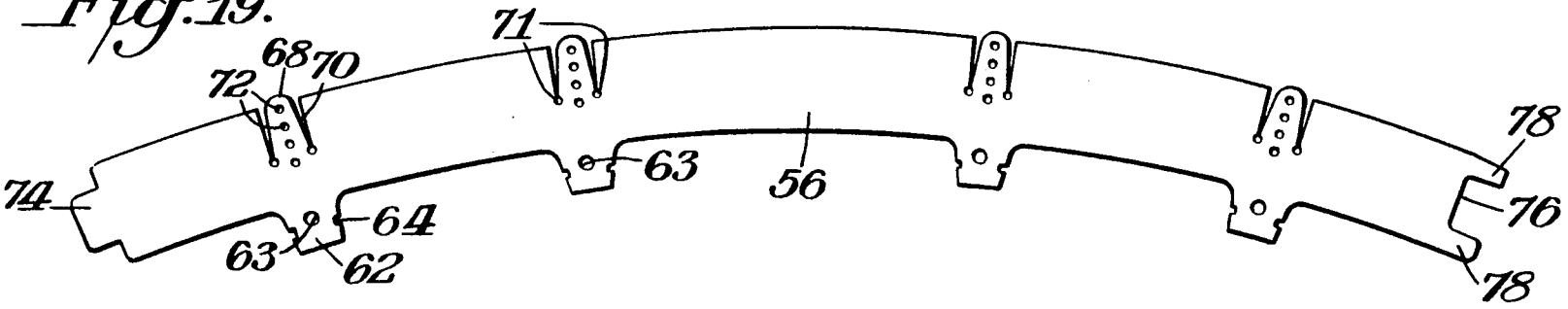
FIG. 19 is a front elevational view of a liner used in the cap of this invention.

In the preferred practice of this invention a plurality, preferably four tabs or plates 58 are secured to band 36. Each plate 58 is integrally molded across the top of at least one and preferably three undulations of attenuator band 36 as shown in FIGS. 13-14 and 16. Plate 58 includes a longitudinal slot 60. Liner 56 includes a plurality of tongues 62 having notches 64 with a tongue being provided for each plate 58. FIG. 19 best illustrates the details of liner 56. As shown therein each tongue 62 having notches 64 is disposed opposite a second set of tongues 68 formed by providing slits 70 in liner 56. Each tongue 68 has a series of holes 72 for selective mounting of adjustable band 2 by means of a fastener secured to adjustable band 20 and a corresponding hole 72. As illustrated strengthening ribs 59 may be provided at all or selected undulations.

Liner 56 has locking formations at each end so that a closed loop can be formed when the ends are secured together. The locking formations illustrated in FIG. 19 include a tongue 74 which fits in recess or cut-out 76 formed between extensions 78 in the manner illustrated in FIG. 1. Thus, liner 56 forms a closed loop which would be disposed between attenuator band 36 and the head of the user. As indicated, the liner 56 also provides a means of mounting adjustable band 20 to shell 12.

As shown in FIG. 19 small holes 71 are provided at the ends of slits 70 to avoid any tearing of liner 56. Larger holes 63 are provided in tongues 62 to add flexibility to tongues 62 and facilitate their insertion into slots 60. The exposed outer extension 78 is illustrated as being tapered and rounded to avoid an exposed sharp corner.

The plate 58 of attenuator band 36 also provides a means of mounting suspension or web 28. In this respect, the fabric material may be in the form of a one piece strap which is threaded through the various slots 60 of plates 58 with the free ends the of the strap being secured together to form a closed webbing 28.

Figure 11:
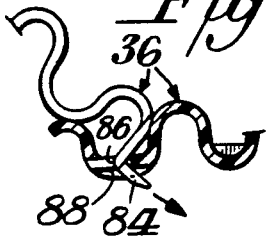
FIG. 11 is a plan view partly in section showing the initial stage of connection of the ends of two pieces which form an attenuator band in accordance with this invention.
Figure 7:
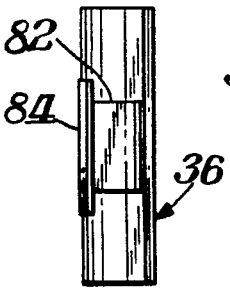
FIG. 7 is a right-end elevational view of one of the pieces in a two piece attenuator band in accordance with this invention.
Figure 9:
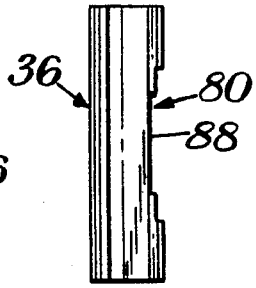
FIG. 9 is a left end elevational view of the attenuator band shown in FIG. 7-8.
Figure 12:
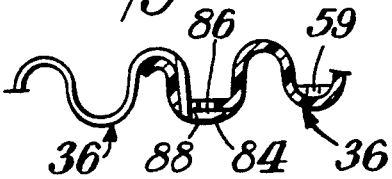
FIG. 12 is a view similar to FIG. 11 showing the final connection of the two pieces.
Figure 18:
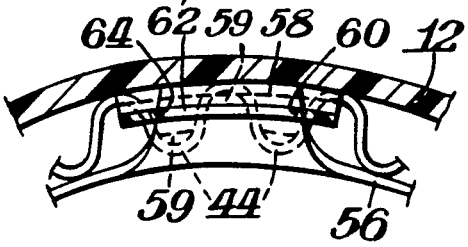
FIG. 18 is a cross-sectional view taken through FIG. 6 along the line 18—18.

In the preferred practice of this invention attenuator band 36 is made of a plurality of pieces and preferably two pieces. FIGS. 13–14 illustrate one of the pieces 36 in the two-piece construction. As shown therein an end undulation includes a T-shaped slot-like opening 80 extending completely therethrough. The opposite end includes a locking member in the form of a projection 82 integral with band 36. A lateral extension 84 in turn is integral with projection 82. Extension 84 is generally offset or perpendicular to projection 82 (FIGS. 14) and the resultant locking member is of generally T configuration. Extension 84 is dimensioned to fit into the widened portion 86 of opening 80. The stem or projection 82 has a width slightly smaller than the narrow portion 88 of opening 80. When it is desired to connect two attenuator band pieces together, the extension 84 of one piece is inserted through the widened portion 86 of opening 80 of the adjacent piece until fully inserted as shown in FIG. 11. The ends are then manipulated by tilting extension 84 so that there is clearance to permit projection 82 to pass into the narrow portion 88 of T-shaped slot 80 until extension 84 becomes trapped in the narrower portion 88 of opening 80 and the connection is completed as shown in FIG. 12. When attenuator band 36 is made of two or more pieces it is easier to pack, ship and store the attenuator band by having the smaller pieces in a flat condition. This convenience especially applies after the webbing 28 is installed.

FIG. 16 illustrates an alternative form where attenuator band 36A is made of one piece construction including the same elements of the individual pieces of attenuator band 36 except that with band 36A it is only necessary to lock one end of the band to its opposite end.

Although the various figures illustrate the liner 56 to be disposed against the undulations of the corrugated attenuator band, it is to be understood that the invention may be practiced where there is a spacing between the liner 56 and attenuator band 36.

Figure 5:
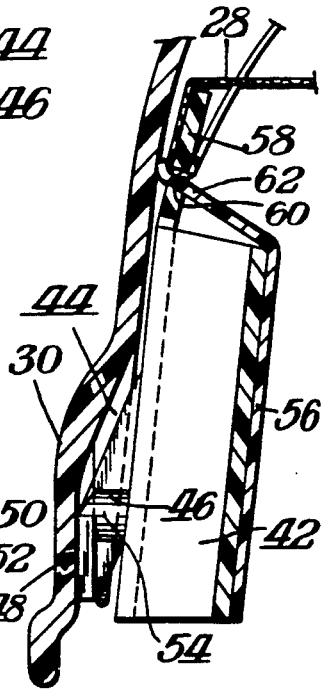
FIG. 5 is a cross-sectional view in elevation taken through FIG. 1 along the line 5—5.

In practice, it is possible to pack, ship and store the various parts of cap 10 as individual components. When it is desired to assemble the components adjustable band 20 would be secured to liner 56 by the use of appropriate fasteners in selected openings 72. Attenuator band 36 or 36A would be assembled by securing the ends of the adjacent attenuator bands to each other until a closed loop is formed as shown in FIGS. 11–12. Liner 56 would be secured to attenuator band 36 by inserting tongue 62 into slot 60 of plate 58 for each of the sets of tongues and plates, as shown in FIG. 5. Webbing suspension 28 would also be secured through the various slots 60 of the plates 58 as previously described. In the preferred practice four such plates 58 are used and the webbing forms an X with a pair of side strips as best shown in FIG. 1.

After the headband assembly has been formed in the above manner, the assembly is mounted to the inner surface of shell 12. FIGS. 3–5 illustrate the sequence of operation in this mounting. As shown in FIGS. 3–4 each button 48 of attenuator band 36 is disposed in line with the appropriate slot 46 between flanges 44 at each energy distributing point 30. Each button 48 is then moved so that its stem 54 slides in the slot 46 until the button is fully seated in the pocket formed between flanges 44 and the wall of point 30, as shown in FIG. 5.

In addition to attenuator band 36 absorbing impact from lateral forces, the corrugated structure of attenuator band 36 has other advantages. For example, the vertical channels formed by the undulations provide direct access for the passage of air into the interior of cap 10. Thus, attenuator band 36 provides effective ventilation which is a significant advantage. The lightweight and durability properties of attenuator band 36 are also advantages. The key feature, however, of attenuator band 36 is its ability to give a wedge like response in the transmission of a direct lateral force perpendicular to the wearer's head into a lateral force parallel to the wearer's head which is propagated through the attenuator band 36, thus the loops or undulations within band 36 act as springs which compress to absorb a portion of the impact energy. The cap of this invention not only supplements the proven system for absorbing or distributing vertical forces by providing a system directed to horizontal or lateral forces, but also the invention simplifies the structure of the vertical force system.

What is claimed is:

1. An impact absorbing protective cap comprising a rigid shell for fitting over the head of the wearer, said shell being generally hemispherical in shape terminating in a peripheral edge which defines an open space therebetween, an attenuator band, connecting means mounting said attenuator band to the inner surface of said shell generally at said peripheral edge, a suspension webbing within said shell remote from said peripheral edge, said suspension webbing being mounted to said attenuator band, said attenuator band being made of a hard flexible high impact material, said attenuator band being of corrugated form with a series of undulations alternately disposed toward and away from said inner surface of said shell, alternating undulations being in contact with said inner surfaces of said shell, said material of said attenuator band being capable of energy absorbing deformation to distribute lateral impact forces striking the outer surface of said shell for protecting the wearer, and said undulations comprising vertical ventilation passages to permit the flow of air therethrough.

2. The cap of claim 1 wherein said attenuator band forms a closed loop.

3. The cap of claim 2 wherein said attenuator band is made of at least one band member having a key end and a slot end, and said key being inserted into and locked to a respective slot end.

4. The cap of claim 3 wherein said key and terminates in a T-shaped extension, and said slot end includes a T-shaped slot.

5. The cap of claim 2 wherein said shell includes a plurality of spaced energy distributing points located around said shell generally at said peripheral edge for distributing vertical impact forces.

6. An impact absorbing protective cap comprising a rigid shell for fitting over the head of the wearer, said shell being generally hemispherical in shape terminating in a peripheral edge which defines an open space therebetween, an attenuator band, connecting means mounting said attenuator band to the inner surface of said shell generally at said peripheral edge, said attenuator band being made of a hard flexible high impact material, said attenuator band being of corrugated form with a series of undulations alternately disposed toward and away from said inner surface of said shell, alternating undulations being in contact with said inner surface of said shell, said material of said attenuator band being capable of energy absorbing deformation to distribute lateral impact forces striking the outer surface of said shell for protecting the wearer, said undulations comprising vertical ventilation passages to permit the flow of air therethrough, said attenuator band forming a closed loop, said shell including a plurality of spaced energy distributing points located around said shell generally at said peripheral edge for distributing vertical impact forces, each of said energy distributing points comprising an outward bulge of said shell, a pocket disposed on said inner surface of said shell opposite said bulge, and said connecting means including a locking member mounted in each of said pockets.

7. The cap of claim 6 wherein each of said pockets is formed by a pair of flanges at said bulge disposed toward and spaced from each other to form a slot, said locking member comprising a button having an outwardly extending flange mounted on a stem connected to said attenuator band, and said stem being disposed in said slot with said flange being disposed in said pocket.

8. The cap of claim 7 including a liner in the form of a closed loop disposed within and mounted to said attenuator band.

9. The cap of claim 8 including a suspension webbing within said shell remote from said peripheral edge, and webbing mounting means mount said suspension webbing to said attenuator band.

10. An impact absorbing protective cap comprising a rigid shell for fitting over the head of the wearer, said shell being generally hemispherical in shape terminating in a peripheral edge which defines an open space therebetween, an attenuator band for distributing lateral impact forces striking the outer surface of said shell, connecting means mounting said attenuator band to the inner surface of said shell generally at said peripheral edge, said attenuator band being made of a flexible high impact material, said attenuator band being of corrugated form with a series of undulations alternately disposed toward and away from said inner surface of said shell, said undulations comprising vertical ventilation passages to permit the flow of air therethrough, said attenuator band forming a closed loop, said shell including a plurality of spaced energy distributing points located around said shell generally at said peripheral edge for distributing vertical impact forces, each of said energy distributing points comprising an outward bulge of said shell, a pocket disposed on said inner surface of said shell opposite said bulge, said connecting means including a locking member mounted in each of said pockets, each of said pockets being formed by a pair of flanges at said bulge disposed toward and spaced from each other to form a slot, said locking member comprising a button having an outwardly extending flange mounted on a stem connected to said attenuator band, said stem being disposed in said slot with said flange being disposed in said pocket, a liner in the form of a closed loop disposed within and mounted to said attenuator band, a suspension webbing within said shell remote from said peripheral edge, webbing mounting means mounting said suspension webbing to said attenuator band, said attenuator band having an upper edge, a plurality of spaced plates extending upwardly from said upper edge of said attenuator band, and said liner and said suspension webbing being mounted to each of said plates whereby said plates comprise said webbing mounting means.

11. The cap of claim 10 wherein each of plates includes an elongated lateral slot, said liner including a plurality of notched tongues corresponding to the number of said plates, and each of said notched tongues being inserted through a respective slot and locked to is respective plate.

12. The cap of claim 11 wherein said suspension webbing is a flexible strap inserted through each of said slots.

13. The cap of claim 12 wherein each of said plates extends across a plurality of said undulations.

14. The cap of claim 13 wherein each of said buttons is located at a cut out portion of a respective undulation.

15. The cap of claim 14 including an adjustable head band mounted to said liner for accommodating the size of the wearer.

16. The cap of claim 15 wherein said attenuator band is made of at least one band member having a key end and a slot end, and said key end being inserted into and locked to a respective slot end.

17. The cap of claim 16 wherein said key end terminates in a T-shaped extension, and said slot end includes a T-shaped slot.

18. The cap of claim 17 wherein said attenuator band comprises a plurality of band members, each of said band members having said key end and said slot end, and said key end of each band member being inserted into said slot end of its adjacent band member.

19. An attenuator band for being mounted to the inner surface of a protective cap for distributing lateral impact forces comprising at least one band member, said band member having a pair of free ends, securing means at one of said free ends, complementary securing means at the other of said free ends for interlocking engagement with said securing means of said at least one band member to form a closed loop, said closed loop made of a hard flexible high impact material, said closed loop being of corrugated form having spaced peripheral edges, said corrugated form comprising a series of open undulations extending from one of said peripheral edges to the other of said peripheral edges to comprise vertical ventilation passages, said material of said attenuator band being capable of energy absorbing deformation to distribute lateral forces applied to said cap for protecting the wearer, spaced locking members on said closed loop for locking said closed loop to the protective cap, each of said locking members comprising a button for fitting in a corresponding slot in the protective cap, spaced mounting members on said closed loop, each of mounting members comprising a plate extending from one of said peripheral edges, and said plate having an elongated lateral slot through which a suspension webbing inside the protective cap may be inserted, each of said buttons having an outwardly extending flange mounted on a stem connected to said closed loop at one of said peripheral edges, and each of said plates extending from the other of said peripheral edges.

20. The attenuator band of claim 21 wherein each of said plates extends across a plurality of said undulations.

21. The attenuator band of claim 19 wherein said closed loop is formed by a plurality of said band members.

22. The attenuator band of claim 19 wherein said securing means at said one of said free ends is a key end, and said complementary securing means at said other of said free ends being a slot end.

23. The attenuator band of claim 22 wherein said key end terminates in a T-shaped extensions, an said slot end includes a T-shaped slot.

24. The attenuator band of claim 9 including a strengthening rib at a plurality of said undulations.

25. An attenuator band for being mounted to the inner surface of a protective cap for distributing lateral impact forces comprising a closed loop made of a flexible high impact material, said closed loop being of corrugated form having spaced peripheral edges, said corrugated form comprising a series of open undulations extending from one of said peripheral edges to the other of said peripheral edges to comprise vertical ventilation passages, spaced locking members on said closed loop for locking said closed loop to the protective cap, spaced mounting members on said closed loop for mounting head gear to said attenuator band, each of said locking members comprising a button having an outwardly extending flange mounted on a stem connected to said closed loop at one of said peripheral edges, each of said mounting members comprising a plate extending from the other of said peripheral edges, said plate having an elongated lateral slot, each of said plates extending across a plurality of said undulations, and each of said buttons being located at a cut out portion of a respective undulation.

26. The attenuator band of claim 25 wherein said closed loop is formed by securing two free ends together, one of said free ends being a key end, and the other of said free ends being a slot end.

27. The attenuator band of claim 1 wherein said key end terminates in a T-shaped extensions, and said slot end includes a T-shaped slot.

28. An impact absorbing protective cap comprising a rigid shell for fitting over the head of the wearer, said shell being generally hemispherical in shape terminating in a peripheral edge which defines an open space therebetween, an attenuator band for distributing lateral impact forces striking the outer surface of said shell, connecting means mounting said attenuator band to the inner surface of said shell generally at said peripheral edge, said attenuator band being made of a hard flexible high impact material, said attenuator band being of corrugated form with a series of undulations alternately disposed toward and away from said inner surface of said shell, said undulations comprising vertical ventilation passages to permit the flow of air therethrough, a liner in the form of a closed loop disposed within and mounted to said attenuator band, a suspension webbing disposed within said shell remote from said peripheral edge, webbing mounting means mounting said suspension webbing to said attenuator band, and an adjustable head band mounted to said liner for accommodating the size of the wearer.

29. The cap of claim 28 wherein said attenuator band forms a closed loop.

30. The cap of claim 29 wherein said shell includes a plurality of spaced energy distributing points located around said shell generally at said peripheral edge for distributing vertical impact forces.

31. The cap of claim 28 wherein each of said energy distributing points comprises an outward bulge of said shell, a pocket disposed on said inner surface of said shell opposite said bulge, and said connecting means including a locking member mounted in each of said pockets.

32. The cap of claim 31 wherein each of said pockets is formed by a pair of flanges at said bulge disposed toward and spaced from each other to form a slot, said locking member comprising a button having an outwardly extending flange mounted on a stem connected to said attenuator band, and said stem being disposed in said slot with said flange being disposed in said pocket.

33. The cap of claim 32 wherein said attenuator band has an upper edge, a plurality of spaced plates extending upwardly from said upper edge of said attenuator band, and said liner and said suspension webbing being mounted to each of said plates.

34. The cap of claim 28 wherein said attenuator band is made of at least one band member having a key end and a slot end, and said key end being inserted into and locked to a respective slot end.

35. The cap of claim 34 wherein said key end terminates in a T-shaped extension, and said slot end includes a T-shaped slot.

36. An impact absorbing protective cap comprising a rigid shell for fitting over the head of the wearer, said shell being generally hemispherical in shape terminating in a peripheral edge which defines an open space therebetween, an attenuator band, connecting means mounting said attenuator band to the inner surface of said shell generally at said peripheral edge, said attenuator band being made of a hard flexible high impact material, said attenuator band being of closed loops form, said attenuator band of single layer construction, said attenuator band being of corrugated form with a series of undulations alternately disposed toward and away from said inner surface of said shell throughout the length of said attenuator band, alternating undulations being in contact with said inner surface of said shell in a uniform pattern around said peripheral edge, said material of said attenuator band being capable of energy absorbing deformation to distribute lateral impact forces striking the outer surface of said shell for protecting the wearer regardless of the location along said peripheral edge where the lateral impact forces are applied, and said undulations comprising vertical ventilation passages to permit the flow of air therethrough.

37. An attenuator band for being mounted to the inner surface of a protective cap for distributing lateral impact forces comprising at least one band member, said band member having a pair of free ends, securing means at one of said free ends, complementary securing means at the other of said free ends for interlocking engagement with said securing means of said at least one band member to form a closed loop, said closed loop made of a hard flexible high impact material, said closed loop being of corrugated form having spaced peripheral edges, said corrugated form comprising a series of open undulations extending from one of said peripheral edges to the other of said peripheral edges to comprise vertical ventilation passages, said material of said attenuator band being capable of energy absorbing deformation to distribute lateral forces applied to said cap for protecting the wearer, said band member having an upper peripheral edge and a lower peripheral edge, spaced locking member on said closed loop for locking said closed loop to the protective cap, each of said locking members comprising a button at said lower peripheral for fitting in a corresponding slot in the protective cap, spaced mounting members on said closed loop, each of mounting members comprising a plate extending from said upper peripheral edge, and said plate having an elongated lateral slot through which a suspension webbing inside the protective cap may be inserted.

38. The attenuator band of claim 37 wherein each of said buttons has an outwardly extending flange mounted on a stem connected to said closed loop at one of said peripheral edges.

39. An attenuator band for being mounted to the inner surface of a protective cap for distributing lateral impact forces comprising at least one band member, said band member having a pair of free ends, securing means at one of said free ends, complementary securing means at the other of said free ends for interlocking engagement with said securing means of said at least one band member to form a closed loop, said closed loop made of a hard flexible high impact material, said closed loop being of corrugated form having spaced peripheral edges, said corrugated form comprising a series of open dulations extending from one of said peripheral edges to the other of said peripheral edges to comprise vertical ventilation passages, said material of said attenuator band being capable of energy absorbing deformation to distribute lateral forces applied to said cap for protecting the wearer, spaced locking members on said closed loop for locking said closed loop to the protective cap, each of said locking member comprising a button for fitting in a corresponding slot in the protective cap, space mounting members on said closed loop, each of mounting member comprising a plate extending from one of said peripheral edges across a plurality of said undulations, and said plate having an elongated lateral slot through which a suspension webbing inside the protective cap may be inserted.

* * * * *